United States Patent [19]

Ham

[11] Patent Number: 4,679,790

[45] Date of Patent: Jul. 14, 1987

[54] BASEBALL EXERCISING DEVICE

[76] Inventor: Yong S. Ham, Jangmi APT 12-1105, 7-Shinchun-Dong, Kangnam-ku, Seoul, Rep. of Korea

[21] Appl. No.: 838,829

[22] Filed: Mar. 12, 1986

[51] Int. Cl.[4] ..... A63B 69/40

[52] U.S. Cl. ..... 273/26 E; 273/29 A

[58] Field of Search ..... 273/26 R, 26 E, 29 A, 273/200 B, 184 R, 184 B, 185 D, 197 R, 181 D, 202, 185 C, 200 A, 200 R, 197 A, 199 R, 199 A

[56] References Cited

U.S. PATENT DOCUMENTS

| | | | |
|---|---|---|---|
| 1,862,044 | 6/1932 | White | 273/26 E |
| 1,890,696 | 12/1932 | Rosenhahn | 272/78 |
| 2,818,255 | 12/1957 | Ponza | 273/26 E |
| 3,368,518 | 2/1968 | Anthony | 272/78 |
| 3,794,320 | 2/1974 | Salmont | 273/26 E |
| 4,105,203 | 8/1978 | Cho | 273/29 A |

*Primary Examiner*—Richard C. Pinkham
*Assistant Examiner*—T. Brown
*Attorney, Agent, or Firm*—Birch, Stewart, Kolasch & Birch

[57] ABSTRACT

A portable baseball hitting device comprising a column member adapted to extend in a substantially vertical direction, an arm member rotatably connected at one end to the column member, the arm member extending radially from the column member in a substantially horizontal direction with the other end thereof being adapted to contain a baseball, a spring is operatively connected with the column member and the arm member so as to bias the arm member relative to the column member whereby when a batter hits the ball, the arm member is caused to rotate in a clockwise direction around the column member, against the bias of the spring and when the arm member stops its clockwise rotation, the spring causes the arm member to rotate counter-clockwise to return to its initial hitting position. A housing is rotatably mounted at one end of the column member. The housing supports the arm member and contains the spring. A hydraulic cylinder has a piston which is connected to a pin on the surface of the housing. The piston contains a valve which initially retards counter-clockwise rotation of the housing and arm member.

11 Claims, 3 Drawing Figures

BASEBALL EXERCISING DEVICE

BACKGROUND AND FIELD OF THE INVENTION

The present invention relates to a baseball exercising device and more particularly to an improved batting mechanism whereby a ball attached to a device is struck with a bat and caused to rotate in one direction and recoil to its original position. The exercise device of the present invention is particularly useful in improving the baseball hitting skill of a baseball player.

Many types of exercise devices for increasing baseball skill have been developed and used extensively in the sport industry. For example, U.S. Pat. No. 3,069,169 discloses a batting assembly which simulates the manner in which an actual baseball player controls his bat, and U.S. Pat. No. 4,078,800 is directed to a toy playing game, as for example baseball, and includes a pair of player devices. However, none of these devices relate to a ball attached to a rotating main body which, upon being struck with a bat, can be rotated in one direction and recoiled in an opposite direction.

OBJECTS AND SUMMARY OF THE INVENTION

Accordingly, it is therefore an object of the present invention to provide an improved exercise device for improving baseball skill.

Another object of the present invention is to provide a baseball exercising machine for improving batting skill which can be easily played to improve one's mechanical and intellectual talent.

Still another object of the present invention is to provide a housing having an arm to which a baseball is attached. The arm can be rotated to a clockwise direction when struck by a bat and then rotated in an opposite direction in both a slow and fast mode to simulate a ball being pitched.

Yet another object of the present invention is to provide a portable, movable, simple, inexpensive baseball exercising device for use everywhere, including the home.

A further object of the present invention is to provide a baseball playing device which is provided with a means for adjusting the height of the baseball mounted on the device.

Other objects and further scope of applicability of the present invention will become apparent from the detailed description given hereinafter. It should be understood, however, that the detailed description and specific examples, while indicating preferred embodiments of the invention, are given by way of illustration only, since various changes and modifications within the spirit and scope of the invention will become apparent to those skilled in the art from this detailed description.

The present invention is directed to a baseball exercising device to be repeatedly used by batters to improve their batting skills as well as their intellectual approach to the game.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE INVENTION

Figure 1:
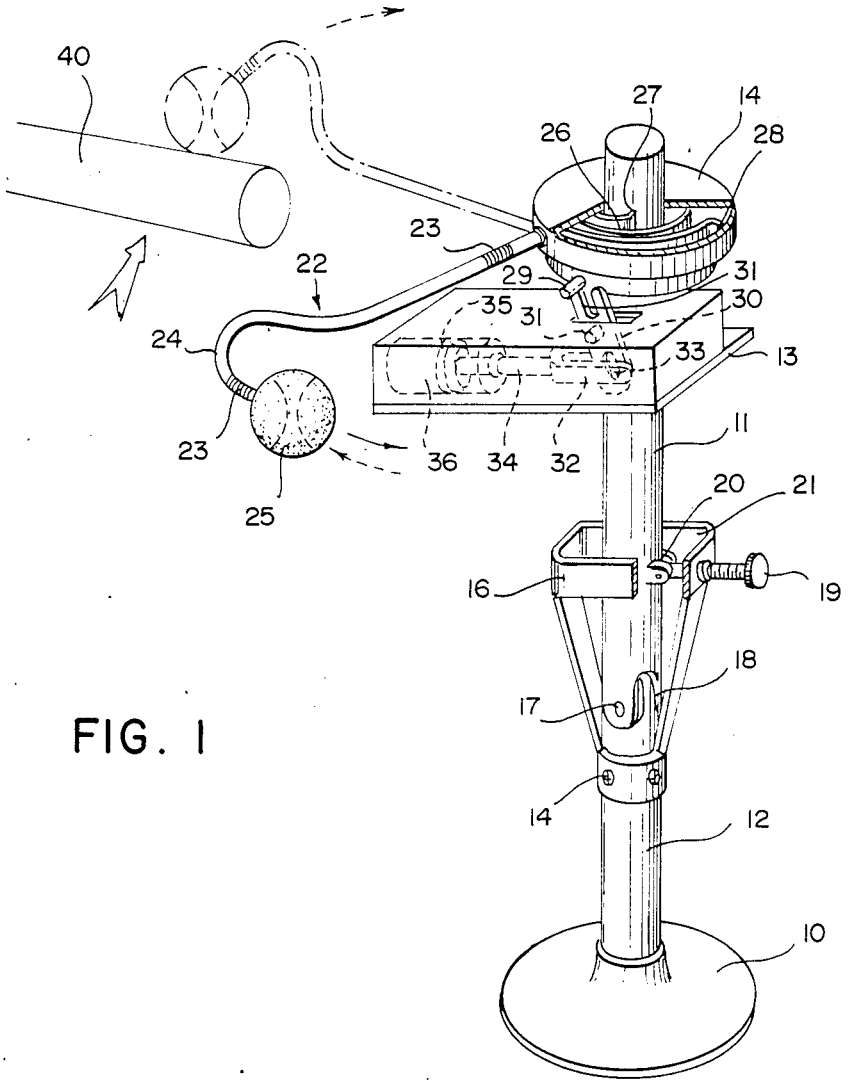
FIG. 1 is a perspective view of the baseball exercising device of the present invention.
Figure 2:
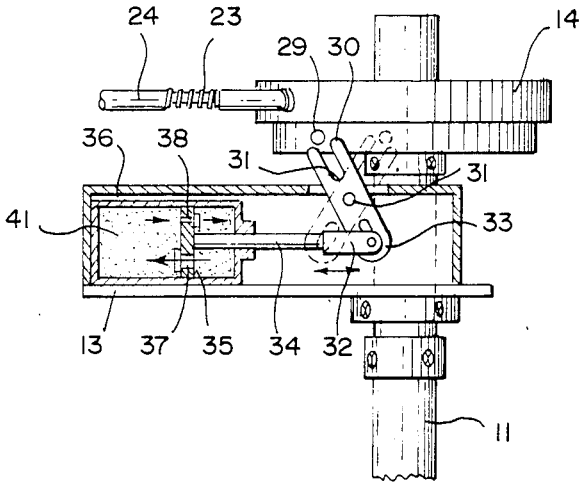
FIG. 2 is a front view of an upper portion of FIG. 1 showing a cross-sectional view of an oil pressure cylinder utilized in the present invention.
Figure 3:
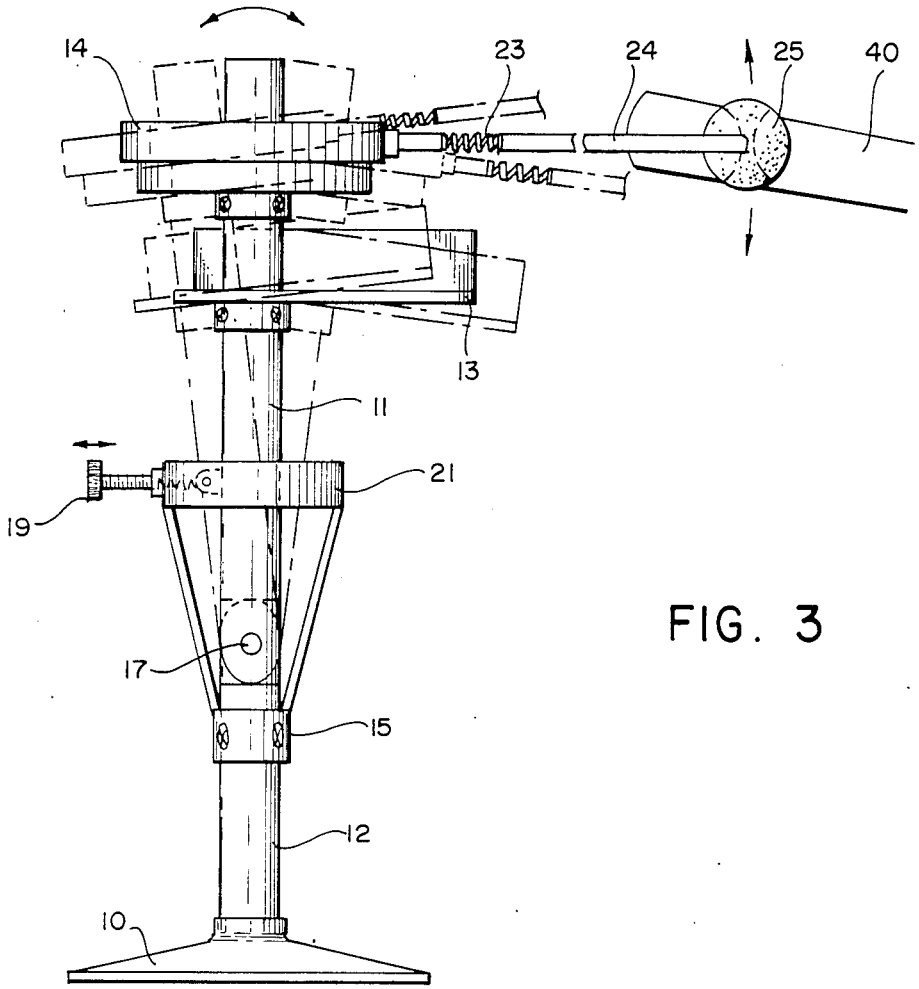
FIG. 3 is a front view of an upper portion of the baseball device showing how an upper column can be adjustably inclined according to the present invention.

The baseball exercising device of the present invention, as shown in FIG. 1, comprises a base plate 10, upper and lower columns 11 and 12 disposed on the base plate 10, a rotatable housing 14 positioned at the top of the upper column and a bracket 13 mounted to the upper column 11. The base plate 10 is mounted to the lower column 12. The lower column 12 pivotally connects to the upper column through a bolt 17. The upper column 11 has grooves 18 disposed at both sides of one end portion thereof so that the upper column 11 can be inclined to the right or left side. Also, a fixture member 15 is mounted to the lower column 12 and extends to a holder 16 which circumscribes the upper column 11. An adjustable screw 19 passes through the holder 16 and is secured to a securing member 20 for controlling the space from the inside wall of the holder 16 to the upper column 12. Thus, the upper column 11 can be inclined to the right or to the left according to the width of the space 21 by adjusting the screw 19. The rotatable housing 14 contains a coil spring 26 having one end thereof attached to the rotatable housing and the other end fixed to the column 11. A baseball 25 is mounted to an arm member 22 which in turn is attached to the rotatable housing. The arm member 22 is made flexible by inserting a coiled spring 23 into at least one portion thereof. As stated above, the housing 14 contains a clockwise or coiled spring 26 having one end thereof mounted to the upper column 11 at 27 and other end 28 mounted to the wall of the housing 14. When a batter hits the ball 25 with a bat 40, the housing 14 rotates in a clockwise direction and returns by itself due to the recoiling of the spring 26. The housing 14 is also provided with a pin 29 which engages a slot 31 of a lever 30 moving the lever 30 clockwise around a fixing pin 31. The other end of the lever 30 is pivotally connected by a pin 33 to an arm 32 of a piston rod 34 of a piston 35 slidably disposed in a cylinder 36. When the housing 14 rotates in the clockwise direction, the piston 35 moves to an end portion of the cylinder 36 because the pin 29 engages the slot 31 as shown in FIG. 1. As shown in FIG. 2, the piston 35 contains a large valve 37 to permit the oil 41 to communicate from the right to the left side and a small valve to permit the oil 41 to communicate from the left to the right side. Since the oil 41 moves easier from the right side to the left side through the larger valve 37 than from the left to right side through the small valve 38, the piston moves faster to the right than to the left. Accordingly, when the housing 14 rotates in the clockwise direction, the lever 30 does not retard the movement of the housing 14. However, when the rotatable housing 14 returns, that is, rotates in the counter-clockwise direction, the lever 30 retards the movement of the housing 14 but only for a specified distance. Thus, in operation, when the bat strikes the ball, as shown in phantom in FIG. 1, the arm member 22 with the housing rotates clockwise about 300° whereby the pin 29 pushes against the slot 31 of the lever 30 to the position shown in FIG. 1. The lever 30 offers little resistance to the movement of the pin 29 since in this sequence, the piston 35 is moving to the right with the oil moving to the left through the large valve 37. During the clockwise rotation of the housing 14 the spring 28 is wound very tight. As the housing 14 then starts its counter-clockwise rotation the pin 29 first engages slot 31 which forces the piston 35 to the left and the oil to the right through the small valve 38. Because the valve 38 is small, the counter-clockwise rotation is retarded until the pin 29 clears the slot 31 due to the rotation of the slot 31 from, its initial position to the position shown in phantom in FIG. 2. After the pin clears the slot 31, the housing 14 with the arm member 22 is forced to rotate in the counterclockwise position returning the ball to its initial position at considerable speed; presumably with the batter ready to again strike the ball. When the upper column 11 and lower column 12 are connected to each other in a vertical direction, the arm 24 containing the ball 25 moves in the horizontal direction. By rotating the screw 19, in one direction or the other, the upper column 11 can be canted to change the plane of the ball as it is brought into a hitting position. Thus, the ball can be caused to take a rising path or a falling path in order to provide variety of ball paths for the hitter.

When operating the device of the present invention for the first time, the upper column 11 is preferred to connect to the lower column 12 in a substantially vertical direction. However, to increase batting proficiency the path of the ball can be changed, as stated above. Because the counter-clockwise rotation of the arm 22 is initially retarded, the batter has enough time to prepare to bat to again swing at the ball. Advantageously, the height of the arm 24 can be adjusted to accomodate tall and short batters by providing a plurality of vertical locations where the upper member 11 can be connected to the lower member 12. For example a plurality of vertically disposed holes can be provided at the position where the upper member 11 is connected to the lower member 12, whereby by merely sliding one of the members inside the other and connecting them together through aligned holes, the height can be readily changed. Also, the power of the spring 26 can be changed to create a slower counter-clockwise movement of the housing 14. Advantageously, the arm member 22 can contain at least one spring member 23 to give further movement to the ball.

The invention being thus described, it will be obvious that the same may be varied in many ways. Such variations are not to be regarded as a departure from the spirit and scope of the invention, and all such modifications as would be obvious to one skilled in the art are intended to be included in the scope of the following claims.

What is claimed is:

1. A portable baseball hitting device comprising a column member adapted to extend in a substantially vertical direction, a housing rotatably disposed at one end of said column member, an arm member connected at one end to said housing to rotate therewith, said housing being provided at the surface thereof with a pin, said arm member extending radially from said housing in a substantially horizontal direction with the other end thereof being attached to a baseball, a hydraulic cylinder mounted on the column member, said hydraulic cylinder being provided with a means for engaging said pin to retard the initial counter-clockwise rotation of the housing and arm member attached thereto, spring bias means disposed within said housing with one end thereof connected to the housing and the other end thereof connected to the column member whereby when a batter hits the ball, the arm member is caused to rotate in a clockwise direction around said column member, against the bias of the spring means and when the arm member stops its clockwise rotation, the spring means causes the arm member to rotate counter-clockwise to return to its initial hitting position.

2. The portable baseball hitting device of claim 1 wherein the retarding of the counter-clockwise rotation of the arm member enables the batter to reposition himself for the return of the ball to the hitting position.

3. The portable baseball hitting device of claim 1 wherein the engaging means is provided with a slot which engages the pin for a predetermined portion of said counter-clockwise rotation.

4. The portable baseball hitting device of claim 3 wherein the hydraulic cylinder comprises a piston slidably disposed within said cylinder, said piston having a large valve and a small valve which provides easy movement of the piston in one direction and retarded movement in the other direction.

5. The portable baseball hitting device of claim 1 wherein the column member is divided into an upper portion and a lower portion, said upper portion being pivotable from the vertical position to a canted position relative to said lower portion.

6. The portable baseball hitting device of claim 5 wherein means are provided for canting said upper portion relative to said lower portion.

7. The portable baseball hitting device of claim 6 wherein said canting means is a secured means mounted in a bracket which surrounds said column member, said screw means being extendable and extractable within said bracket to vary the position of the upper portion relative to said lower portion.

8. The portable baseball hitting device of claim 5 wherein the upper member and the lower member are in slidable, telescoped relationship so that the length of the device can be adjusted.

9. The portable baseball hitting device of claim 1 wherein a portion of the arm member is provided with at least one spring member.

10. The portable baseball hitting device of claim 9 wherein the arm member contains a spring member at each end portion thereof.

11. The portable baseball hitting device of claim 1 wherein the arm member includes a U-shaped configuration at the end portion thereof containing the baseball.

* * * * *